US005617593A

United States Patent [19]

Pham

[11] Patent Number: 5,617,593

[45] Date of Patent: Apr. 8, 1997

[54] DEVICE FOR LIFTING AND LOWERING A MOVABLE SIDE OF A BABY'S BED

[76] Inventor: Viet Pham, 1530, St-Germain, Villa Saint-Laurent, P. Quebec, Canada, H4L 3S8

[21] Appl. No.: 622,262

[22] Filed: Mar. 27, 1996

[51] Int. Cl.[6] ..... A47D 7/02

[52] U.S. Cl. ..... 5/100

[58] Field of Search ..... 5/100, 428, 429, 5/93.1

[56] References Cited

U.S. PATENT DOCUMENTS

| | | | |
|---|---|---|---|
| 797,852 | 8/1905 | Hayden . | |
| 1,695,571 | 12/1928 | Baxter | 5/100 |
| 2,369,834 | 2/1945 | Lundin | 5/100 |
| 5,165,124 | 11/1992 | Li Hsing | 5/100 |

*Primary Examiner*—Alexandr Grosz

[57] ABSTRACT

A spring loaded pin is provided at both ends of the bottom rails of the movable side and an engageable head is fixedly mounted on each of the posts between which the movable side is mounted. The spring loaded pin is allowed to ride in a guiding track which is formed of a vertical elongated section and a return section provided at the top of the elongated section and as a continuation of the latter, the track being provided in the two posts mentioned above. A shoulder is formed in the elongated section above the junction between the return section and the elongated section. The track has sloping down and rising portions to exert different resistances against the spring loaded pin indicating to the operator that locking is about to take place, that the movable side is about to be unlocked or is in the process of being lowered. This device is safer and easier to operate than presently known devices.

9 Claims, 3 Drawing Sheets

DEVICE FOR LIFTING AND LOWERING A MOVABLE SIDE OF A BABY'S BED

BACKGROUND OF INVENTION (a) Field of the Invention

The present invention relates to a device for lowering or lifting a movable side gate of a baby's crib. More particularly, the invention is concerned with a crib having a side gate which can be manipulated, such as by lifting or lowering it, in all safety, while the device enabling this operation is not apparent to the eye and therefore is not detrimental to the esthetic aspect of the crib.

(b) Description of Prior Art

For safety purpose and to facilitate handling of a baby, it is normal to provide a baby's crib with at least one movable side. Generally, such cribs have a mechanism enabling to lock the movable side in upward position and this lock should not be easily disengaged to protect the safety of the baby as well as that of the person minding the baby. In the guidelines published in Canada Gazette, Part II, Vol. 120, No. 20, it is recommended that "every latching or locking mechanism of a movable side other than a mattress support mechanism, shall (a) require two separate positive and simultaneous actions on the part of the user to release the mechanism; and (b) to engage automatically." It will therefore be seen that for a crib to meet compliance with regulations, it is essential that two actions be involved and that locking be automatic.

A review of the prior art reveals some U.S. Patents. U.S. Pat. No. 797,852 discloses a crib which can be converted to a table or a settee. In modern technology it is obvious that this article would be totally defective, and in any case is not directed at the security of the baby.

U.S. Pat. No. 1,695,571 describes a crib with a side that is adapted to be raised or lowered and requires two actions as suggested by regulations. The locking device, provided by a simple return in a guide member, is so simple as to make it unsafe. Furthermore, since the guide members have to be mounted on the posts, the crib of that Patent is dangerous and unattractive.

The Lunden Patent (U.S. Pat. No. 2,369,834) provides for one movement only when lowering the gate, which is dangerous and contrary to regulations.

Finally, U.S. Pat. No. 5,165,124 issued to Li on Nov. 24, 1992 describes a lifting gate control which requires two actions as prescribed by regulations. Because of the structure of the sliding track in which the rod slides, only one action such as a lifting may cause the gate to be unwillfully lowered down. In other words, this patent provides no safety measure against an accidental unlocking of the locking mechanism. In addition, this device has to be mounted outside the posts which is unattractive and may be dangerous.

It is therefore an object of the present invention to provide a movable side gate of a baby's crib which is safer to operate and is more esthetic.

SUMMARY OF INVENTION

According to the invention, there is provided a device for lifting and lowering a movable side of a baby's crib, the movable side including two end rails connecting a top and a bottom rail, the crib comprising corner post, including two operating posts for mounting the movable side therebetween. The device comprises resiliently loaded pin means provided at the ends of the bottom rail, projections, each having an engageable head portion, provided at an upper portion of said operating posts, each end rail being formed with an engaging slide at an upper portion thereof to engage the engageable head portion of one projection, and means enabling the engageable head portion of the projection to slide along the engaging slide. Each operating post is also integrally formed with a pin guiding track at a lower portion thereof, the track, having a vertical elongated section, and a return section provided at the top of the elongated section as a continuation of the elongated section and rejoining same at a junction short of the top of the elongated section. A sharp depression is formed in the elongated section between the junction and the elongated section top defining an abutment shoulder to engage the pin and prevent same from directly returning into the track below the shoulder. Finally, means are provided in the elongated past the abutment shoulder and in the return section to exert continuous resistance in the pin means as the latter is moved toward and into the return section until it starts moving down in the return section. The pin means is preferably spring loaded.

In accordance with a preferred embodiment a bore is provided at both ends of the bottom rail, each spring loaded pin means comprises a coil spring disposed at the bottom of the bore, a pin with a rounded head having an inner end inserted in the coil spring and ribs provided in the pin which rest against an upper end of the coil spring, and a sleeve provided at the outlet of the bore to receive the pin in sliding engagement therein.

The engaging slide is preferably formed with two lateral jaws both adapted to receive the head portion.

In accordance with another preferred embodiment the elongated section of the track, from bottom to top has a first shallow constant portion of uniform depth, a second deeper rising portion, and a sloping down portion connecting the first and second portions. The second deeper rising portion terminates at the abutment shoulder and the elongated section has a gradually decreasing depth from the abutment shoulder to the top thereof, thereby exerting a first resistance in the resiliently loaded pin means as the latter travels towards the abutment shoulder, and a second resistance in the resiliently loaded pin means as the latter travels from the shoulder to the top of the elongated section.

In accordance with yet another embodiment, the return section comprises a first part at an angle relative to the elongated section and substantially horizontally continuing the track at the top of the elongated section, the first part being followed by a second part meeting the elongated section below the abutment shoulder.

In addition, the first part of the return section may have a gradually rising bottom until it meets the second part, the latter having a uniform depth until it meets the second portion below the abutment shoulder, where the pin means is arranged to abruptly step down into the first portion of the elongated section.

Finally, the first part may be substantially perpendicular to the elongated section, and the second part may be parallel to and then veers toward the elongated portion until meeting same below the abutment shoulder. The junction is preferably formed so as to constitute a downward step.

BRIEF DESCRIPTION OF DRAWINGS

The invention will now be illustrated by means of an embodiment which is given only for the purpose of illustration and which is not intended to restrict the invention thereto. In the drawings.

DESCRIPTION OF PREFERRED EMBODIMENT

Figure 1:
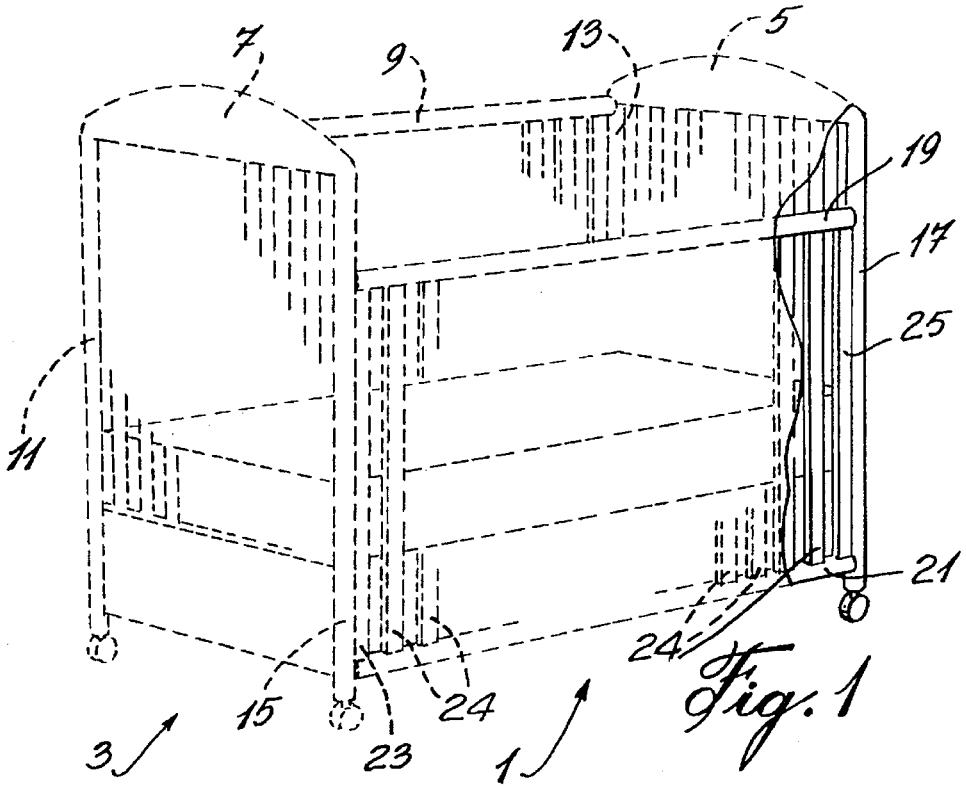
FIG. 1 is a perspective view of a baby's crib according to the invention.

As illustrated, this invention deals with the movable side 1 of a baby's crib 3. Crib 3 is, of course, of standard structure and comprises movable side 1, front side 5, rear side 7, and opposite lateral side 9. The bed also includes four corner posts 11, 13, 15 and 17. Posts 15 and 17 will hereafter be referred to as operating posts. As shown, movable side gate 1 is mounted between operating posts 15 and 17, as will be described later.

The construction of movable side 1 is conventional and includes top rail 19, bottom rail 21, and end rails 23, 25. A plurality of bars 24 are disposed between the end rails 23 and 25.

Figure 7:
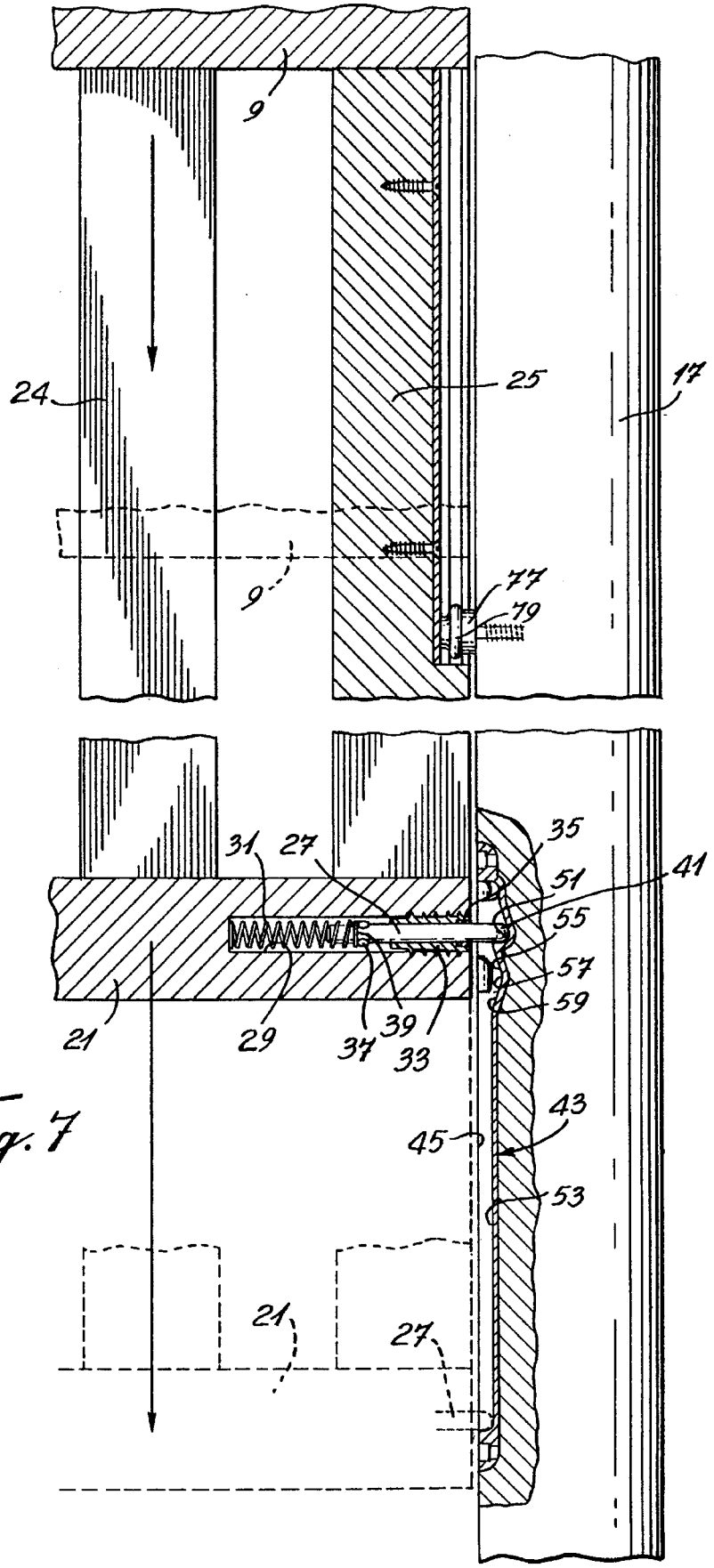
FIG. 7 is a cross-section view through one of the end rail and corresponding operating post, showing the operation of the invention.

With reference to FIG. 7, it will be seen that a spring loaded pin 27 is mounted at both ends of bottom rail 21. More particularly, a bore 29 as shown in the drawings is formed at each end of bottom rail 21. A coil spring 31 is then mounted in known manner, as shown, at the bottom of bore 29. In addition, a sleeve 33 provided with a collar 35 is mounted at the outlet of bore 29. Pin 27 is formed in known manner with ribs 37 which are arranged to rest against the upper end 39 of coil spring 31. Finally, for a smooth operation of the device, pin 27 has a rounded head 41.

Figure 2:
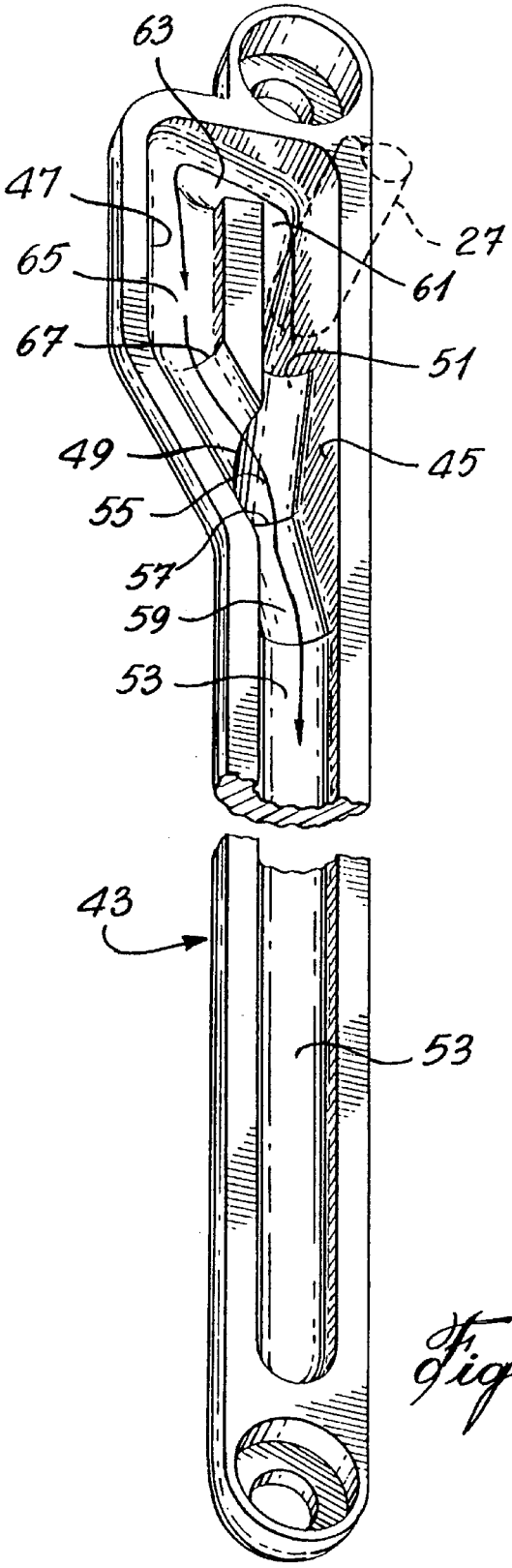
FIG. 2 is a perspective view of the guiding track.
Figure 4:
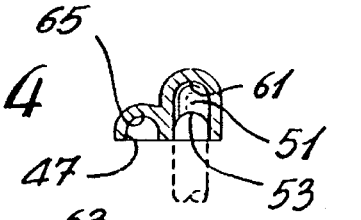
FIG. 4 is a cross-section taken along line 4—4 of FIG. 3.
Figure 5:
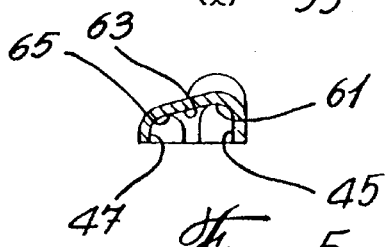
FIG. 5 is a cross-section taken along line 5—5 of FIG. 3.

As further shown in the drawings, the device according to the invention also includes a pin guiding track 43 which is integrally formed or provided in operating post. Post 17 is arranged in the same manner as post 15 but with a mirror view of the part 43. With particular reference to FIG. 2, it will be seen that pin guiding track 43 has a vertically elongated section 45 and a return section 47, the latter being in the continuation of elongated section 45 and rejoining it at junction 49 short of the top of elongated section 45. With particular reference to the elongated section 45, the latter will be seen to be formed with a sharp depression between rising portion 55 and the top of the elongated section, which depression defines an abutment shoulder 51. As shown, the latter is intended to engage pin 27 as it rides up the elongated section, snaps into the depression and prevents it from directly returning into the track below shoulder 51.

Figure 3:
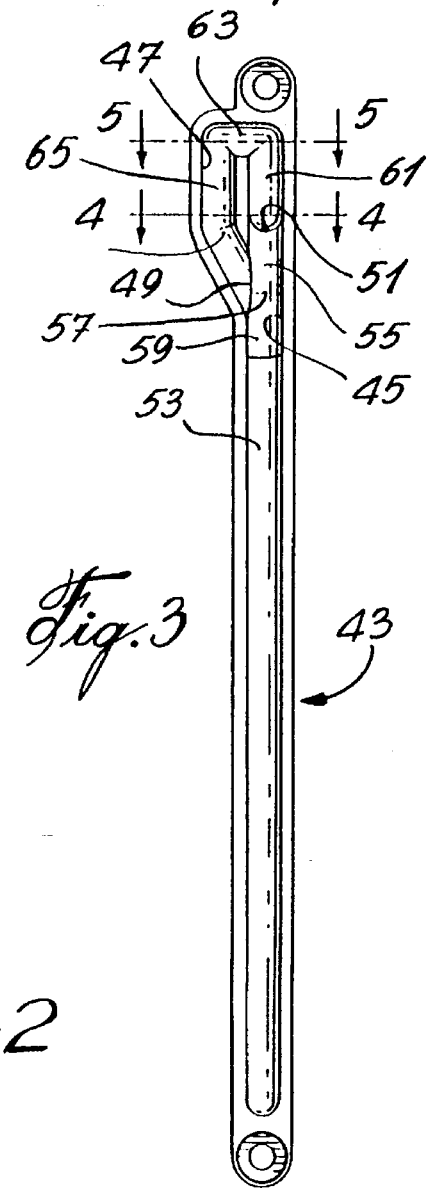
FIG. 3 is a front view of the guiding track illustrated in FIG. 2.

Referring to FIG. 2 and FIG. 3, for more details of the pin guiding track, a description will first be made of the elongated section from bottom to top. Section 45 has a first shallow portion 53 of constant uniform depth and it will be seen that the bottom floor is provided with a concave shape so as to conform exactly with head 41 of pin 27 when the latter is engaged in the pin guiding track. This is also true of the bottom floor for the entire elongated and return sections. Elongated section 45 also has a rising portion 55 (as mentioned above) which starts at 57 and ends at 51. Connecting shallow portion 53 and rising portion 55, there is a sloping down portion 59. Finally, from abutment shoulder 51 to the top of the elongated section, there is a top portion 61 which gradually decreases in depth from the abutment shoulder 51 to the top of the elongated section. It will therefore be seen that as pin 27 travels upwardly in the elongated section 45 of pin guiding track 43, a uniform resistance will first be exerted against pin 27 during its travel in portion 53. Then, as the pin rides along portion 59, this resistance will decrease until reaching meeting point 57 between section 59 and section 55. As the pin travels along section 55, resistance will increase until the pin reaches abutment shoulder 51 where the clicking sound takes place thereby indicating to the operator of movable gate 1 that locking is taking place. Full operation of the movable side will be described later, however, for the time being it should be mentioned that if an upward movement is exerted on movable side 1 wherein pin 27 rides along portion 61, a new resistance will be exerted in the spring loaded pin 27 indicating that the pin is moving towards the top of the track or elongated section 45.

Turning now to return section 47, as shown, it will be seen to comprise a first part 63 which in the illustrated embodiment is perpendicular to the elongated section, and more particularly to the rising portion 61. Part 63, as shown, has a rising bottom until reaching the second part 65 of the return section which is downwardly directed and is perpendicular to horizontal part 63. As shown, part 65 is also parallel to the elongated section 45 for a certain distance until it veers at 67 towards the elongated section 45, to end at junction 49. Also as shown, it will be seen that from the top of part 65 until its junction with elongated section 45, the bottom of return section 47 has a constant uniform depth. Therefore, as pin 27 descends along part 65 of the return section, resistance will first be constant and will then abruptly change at junction 49 where, because of the downward step at junction 49, a slight click will be heard and a slight effort will have to be exerted to cause the pin to ride up to portion 53. Of course, a similar arrangement is provided for both operating posts 15 and 17 and at both ends of bottom rail 21.

The lower parts of operating posts 15, 17 are prevented from spreading apart by means of a brace, not shown, which connects front and rear sides 5, 7 under the bed spring frame, not shown, in the vicinity of movable side 1.

Figure 6:
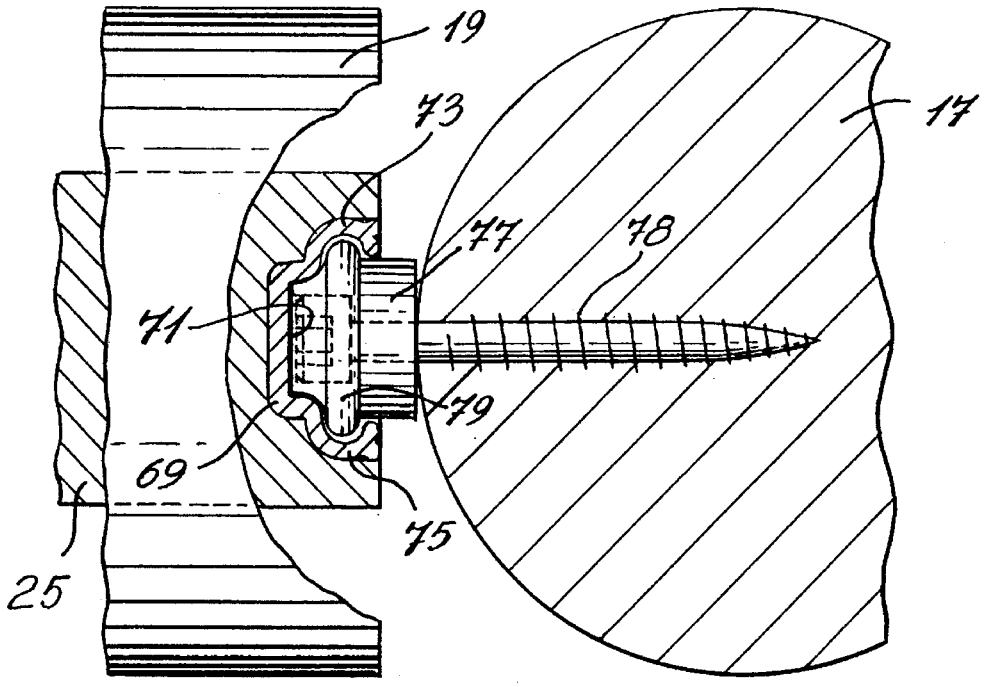
FIG. 6 is a cross-section view of the track and the sliding guide.

To prevent the operating posts 15 and 17 from spreading apart at the top, there is provided an engagement between the upper section of end rails 23 and 25 and the two operating posts 15 and 17. This arrangement first comprises an engaging slide 69, which is constructed as shown in FIG. 6 of the drawings, and is disposed in both end rails 23, 25. However, any other type of construction known to those skilled in the art could be used. In the illustrated embodiment, the slide comprises a channel portion 71 and a pair of engaging jaws 73, 75. As shown, both operating posts 15, 17 are provided with an engaging member 77 which is fixed into posts 15, 17 in known manner, such as by the use of screwing means 78, the engaging member being formed with an engageable head 79 which is adapted to fit between jaws 73 and 75. This arrangement will obviously prevent any spreading apart of operating posts 15, 17 at the top thereof.

In operation, it will be obvious that engageable member 77 will slide in engaging slide 71 while pin 27 will ride along track 43 formed with an elongated section 45 and a return section 47. If the intention is to lift the movable side 1 from a lower position to an upper position, it will be seen that the pin will ride along portions 53, 59, 55 until it engages over shoulder 51. The idea of the various inclinations of parts 55 and 59 is to prevent pin head 41 from traveling toward return section 47 of the track, and instead guide it along portion 55 to shoulder 51, if desired. More particularly, the operation will be smoother as the pin rides down portion 59 until reaching junction 57. Then, resistance will increase indicating that locking is imminent. As soon as the pin rides over shoulder 51, an abrupt change of the depth will cause spring loaded pin 27 to knock at the bottom portion 61 creating a click sound, and movable side 1 is then locked in upper position. If it is intended to lower the movable side 1, one first has to lift the gate past its locking position during which a higher resistance is exerted against the pin. This is the first action recommended by the guidelines. When reaching the top of the elongated section one has to exert an inward movement against bottom rail 21 to enable the pin to ride along part 63 during which resistance continues to increase. This is the second action recommended by the guidelines. When the pin head has reached the end of part 63, it is impossible to continue the inward movement of rail 21 and consequently, this tells the operator that it is time to stop maintaining a lifting effort for a downward movement of the movable side 1 and also stop the inward effort applied against rail 21. Since resistance against pin 27 is constant, as the latter travels along part 65 until it meets junction 49, the downward movement of the movable side is nearly automatic. Once again, at junction 49, in downward direction, there is another change of the depth, which is less than at shoulder 51, to give another slide clicking sound, announcing to the operator that the gate is on its way to its lowermost position. In other words, the gate is ready for an upper locked position.

It is understood that modifications may be made to the illustrated embodiment without department from the spirit and scope according to the present invention.

I claim:

1. Device for lifting and lowering a movable side of a baby's crib, said movable side including two end rails connecting a top and a bottom rail, said crib comprising corner posts, including two operating posts for mounting said movable side therebetween, said device comprising resiliently loaded pin means provided at the ends of said bottom rail, projections, each having an engageable head portion, provided at an upper portion of said operating posts, each said end rail formed with an engaging slide at an upper portion thereof to engage said engageable head portion of one said projection, and means enabling said engageable head portion of said projection to slide along said engaging slide, each operating post also integrally formed with a pin guiding track at a lower portion thereof, said track, having a vertical elongated section, and a return section provided at the top of said elongated section as a continuation of said elongated section and rejoining same at a junction short of the top of said elongated section, a sharp depression formed in said elongated section between said junction and said elongated section top defining an abutment shoulder to engage said pin and prevent same from directly returning into said track below said shoulder, means provided in said elongated section past said abutment shoulder and in said return section to exert continuous resistance in said pin means as the latter is moved toward said return section and into said return section, until it starts moving down in said return section.

2. Device according to claim 1, wherein said pin means is spring loaded.

3. Device according to claim 2, wherein a bore is provided at both ends of said bottom rail, each said spring loaded pin means comprises a coil spring disposed at bottom of said bore, a pin with a rounded head having an inner end inserted in said coil spring and ribs provided in said pin which rest against an upper end of said coil spring, and a sleeve at an outlet of said bore to receive said pin in sliding engagement therein.

4. Device according to claim 1, wherein said engaging slide is formed with two lateral jaws both adapted to receive said head portion.

5. Device according to claim 1, wherein the elongated section of said track, from bottom to top has a first shallow constant portion of uniform depth, a second deeper rising portion, and a sloping down portion connecting said first and second portions, said second deeper rising portion terminating at said abutment shoulder, said elongated section having a gradually decreasing depth from said abutment shoulder to the top thereof, thereby exerting a first resistance in said resiliently loaded pin means as the latter travels towards said abutment shoulder, and exerting a second resistance in said resiliently loaded pin means as the latter travels from said abutment shoulder to the top of said elongated section.

6. Device according to claim 5, wherein said return section comprises a first part at an angle relative to said elongated section and substantially horizontally continuing said track at the top of said elongated section, said first part followed by a second part meeting said elongated section below said abutment shoulder.

7. Device according to claim 6, wherein said first part of said return section has a gradually rising bottom until it meets said second part, said second part being uniform in depth until it meets said second portion below said abutment shoulder, where said pin means is arranged to abruptly step down therefrom into said first portion.

8. Device according to claim 7, wherein said first part is substantially perpendicular to said elongated section, said second part is parallel to and then veers toward said elongated portion until meeting same below said abutment shoulder.

9. Device according to claim 8, wherein said junction is formed so as to constitute a downward step.

* * * * *